US006036288A

United States Patent [19]

Shih

[11] Patent Number: 6,036,288

[45] Date of Patent: Mar. 14, 2000

[54] DESKTOP COMPUTER RACK

[76] Inventor: Kun-chi Shih, 77 Chi Pan Road, Lu Kang Township, Changhua Hsien, Taiwan

[21] Appl. No.: 09/090,309

[22] Filed: Jun. 4, 1998

[51] Int. Cl.[7] ..... A47B 81/00

[52] U.S. Cl. ..... 312/223.3; 312/334.8; 248/918

[58] Field of Search ..... 312/223.3, 223.2, 312/334.7, 330.1, 334.8; 248/918

[56] References Cited

U.S. PATENT DOCUMENTS

| | | | |
|---|---|---|---|
| 4,483,572 | 11/1984 | Story | 312/223.3 |
| 4,496,200 | 1/1985 | Hagstrom et al. | 312/223.3 |
| 4,709,972 | 12/1987 | LaBudde et al. | 312/223.3 X |
| 4,901,972 | 2/1990 | Judd et al. | 312/223.3 X |
| 4,923,259 | 5/1990 | Bartok | 312/223.2 |
| 5,062,609 | 11/1991 | Hames et al. | 248/918 X |
| 5,588,727 | 12/1996 | D'Agaro et al. | 312/223.3 X |
| 5,595,428 | 1/1997 | Huang | 312/223.3 |
| 5,706,741 | 1/1998 | Thorp et al. | 108/153.1 X |
| 5,788,346 | 8/1998 | Jacobson et al. | 312/223.2 X |
| 5,802,990 | 9/1998 | Lin | 108/157.1 |

FOREIGN PATENT DOCUMENTS

| | | | |
|---|---|---|---|
| 3132015 | 10/1982 | Germany | 248/918 |

*Primary Examiner*—Peter M. Cuomo
*Assistant Examiner*—Hanh V. Tran
*Attorney, Agent, or Firm*—Bacon & Thomas, PLLC

[57] ABSTRACT

A desktop computer rack is formed of a main body, a keyboard plate, and two slide rail devices fastened with the main body and the keyboard and the keyboard plate to enable the keyboard plate to be slid into or out of the underside of the main body. The main body is provided in the upper surface thereof with a skidproof rack top for locating a desktop computer, and in the underside thereof with a plurality of reinforcing ribs. The main body is provided respectively at the four comers thereof with a through slot to accommodate a leg pad.

8 Claims, 6 Drawing Sheets

DESKTOP COMPUTER RACK

FIELD OF THE INVENTION

The present invention relates generally to a desktop computer accessory, and more particularly to a desktop computer rack.

BACKGROUND OF THE INVENTION

As shown in FIGS. 1 and 2, a desktop computer rack of the prior art has a main body A of a metal material. The main body A is provided in the two opposite ends of the underside thereof with two fixed flaps A1. Located between the two fixed flaps A1 are two reinforcing ribs B for reinforcing the structural strength of the main body A. Such a prior art desktop computer rack as described above is defective in design in that it is not cost-effective, and that its design lacks versatility, and further that it has a very smooth rack top on which a desktop computer can not be securely located, and still further that it can not be orderly piled up to facilitate the packing and the shipping of the rack.

SUMMARY OF THE INVENTION

The primary objective of the present invention is therefore to provide a desktop computer rack free from the drawbacks of the prior art desktop computer rack described above.

In keeping with the principle of the present invention, the foregoing objective of the present invention is attained by a desktop computer rack consisting of a main body, a keyboard plate and two slide rails. The main body is provided with a skidproof top on which the desktop computer is placed. The keyboard plate can be slid into out of the main body, on the two slide rails.

The foregoing objective, features, and functions of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
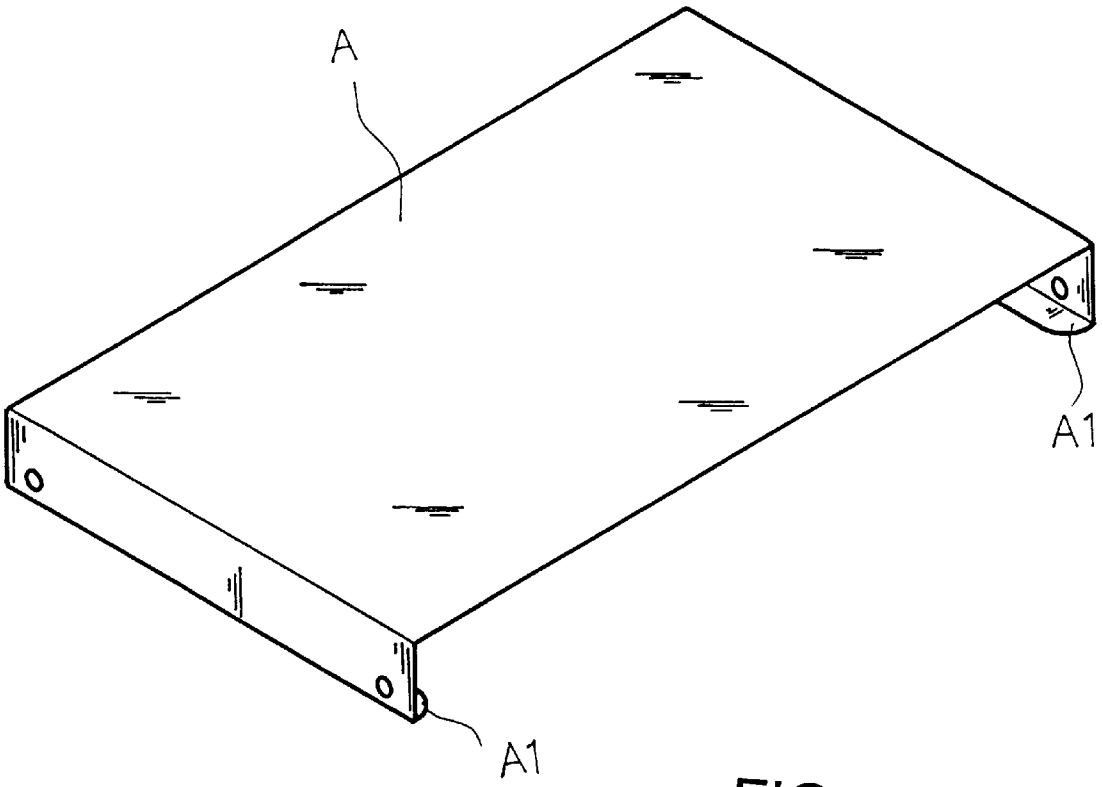
FIG. 1 PRIOR ART
FIG. 1 shows a top perspective view of a desktop computer rack of the prior art.
Figure 2:
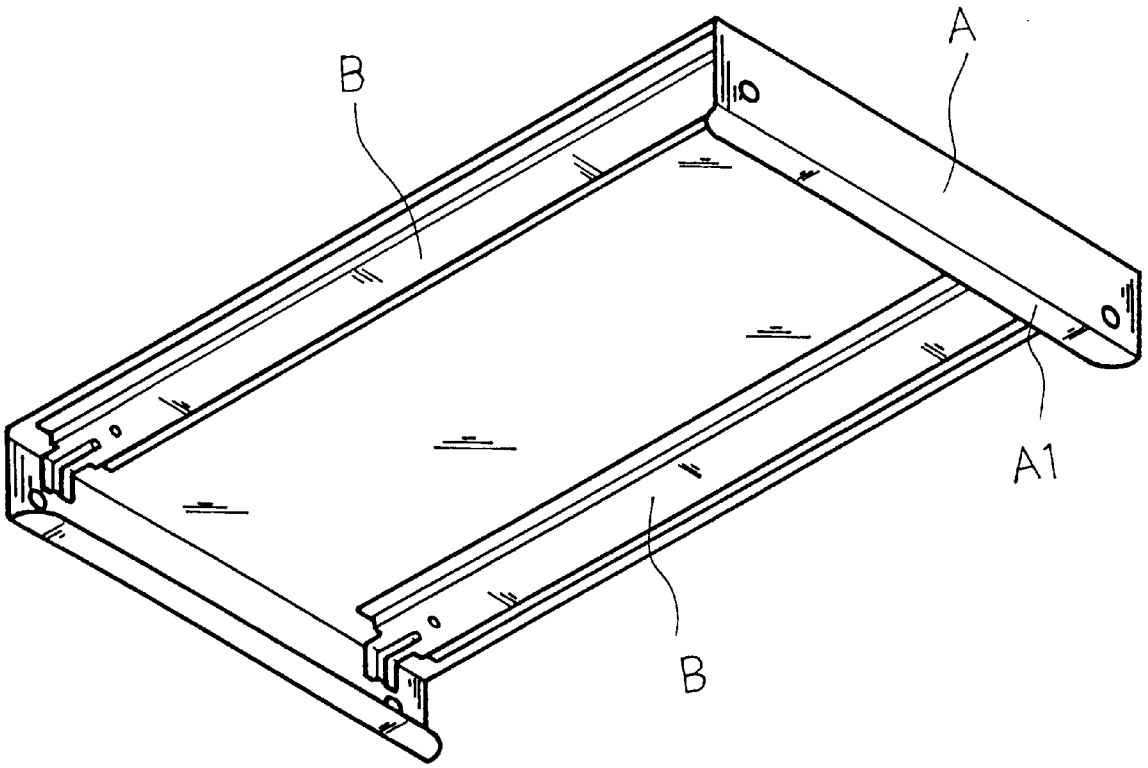
FIG. 2 PRIOR ART
FIG. 2 shows a bottom perspective view of the desktop computer rack of the prior art.
Figure 3:
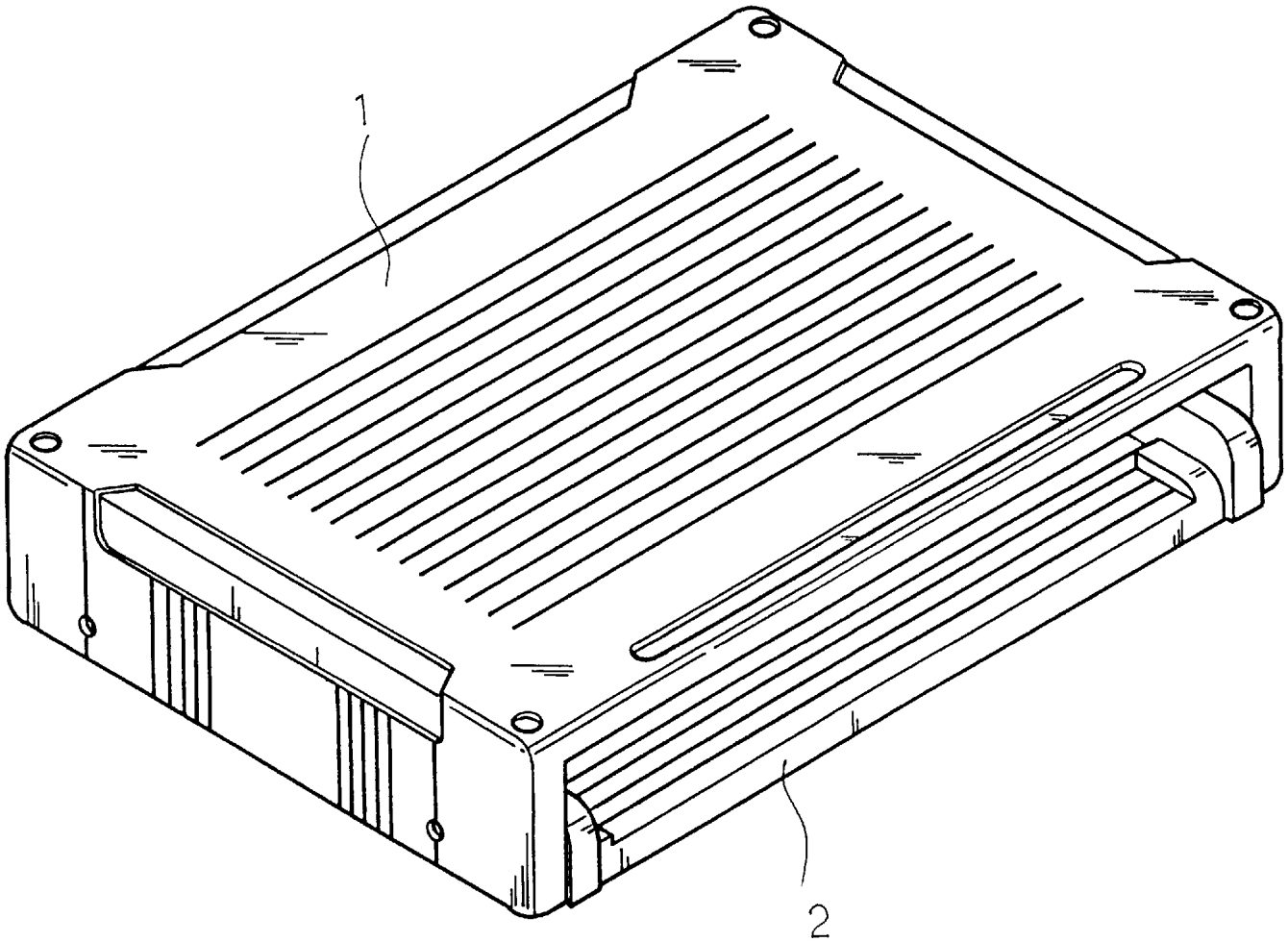
FIG. 3 shows a top perspective view of a desktop computer rack of the present invention.
Figure 4:
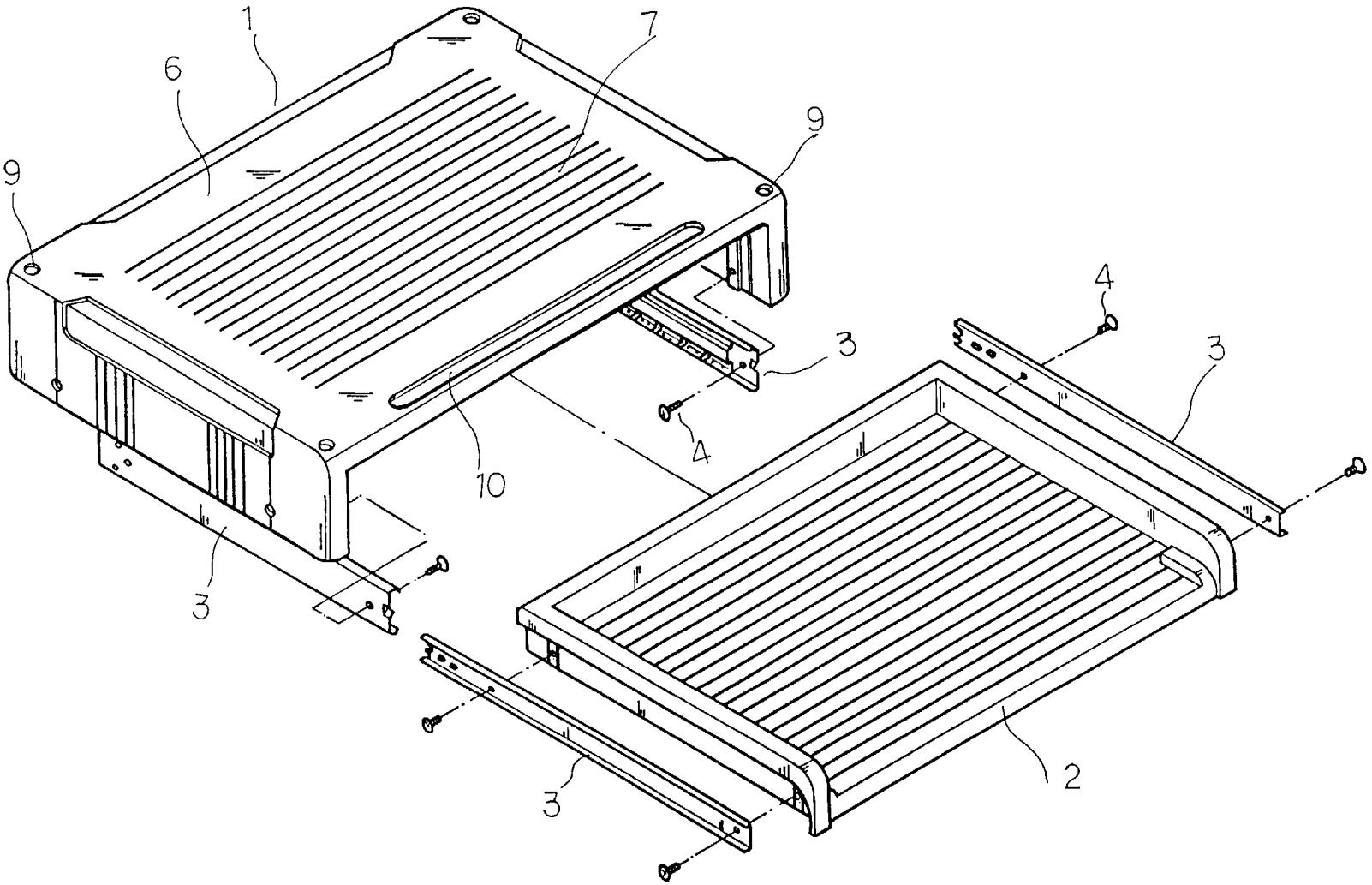
FIG. 4 shows an exploded view of the desktop computer rack of the present invention.
Figure 5:
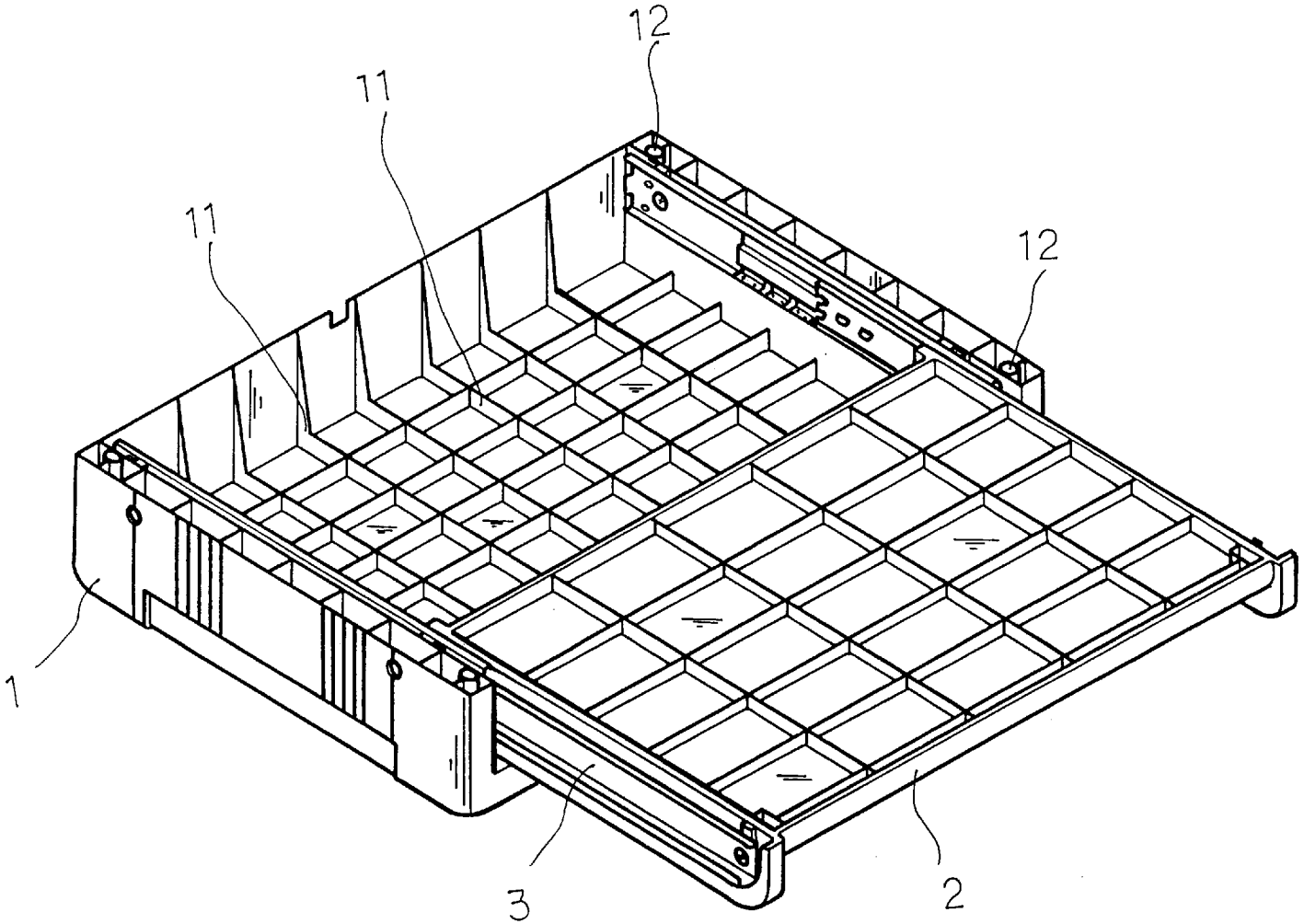
FIG. 5 shows a bottom perspective view of the desktop computer rack of the present invention.
Figure 6:
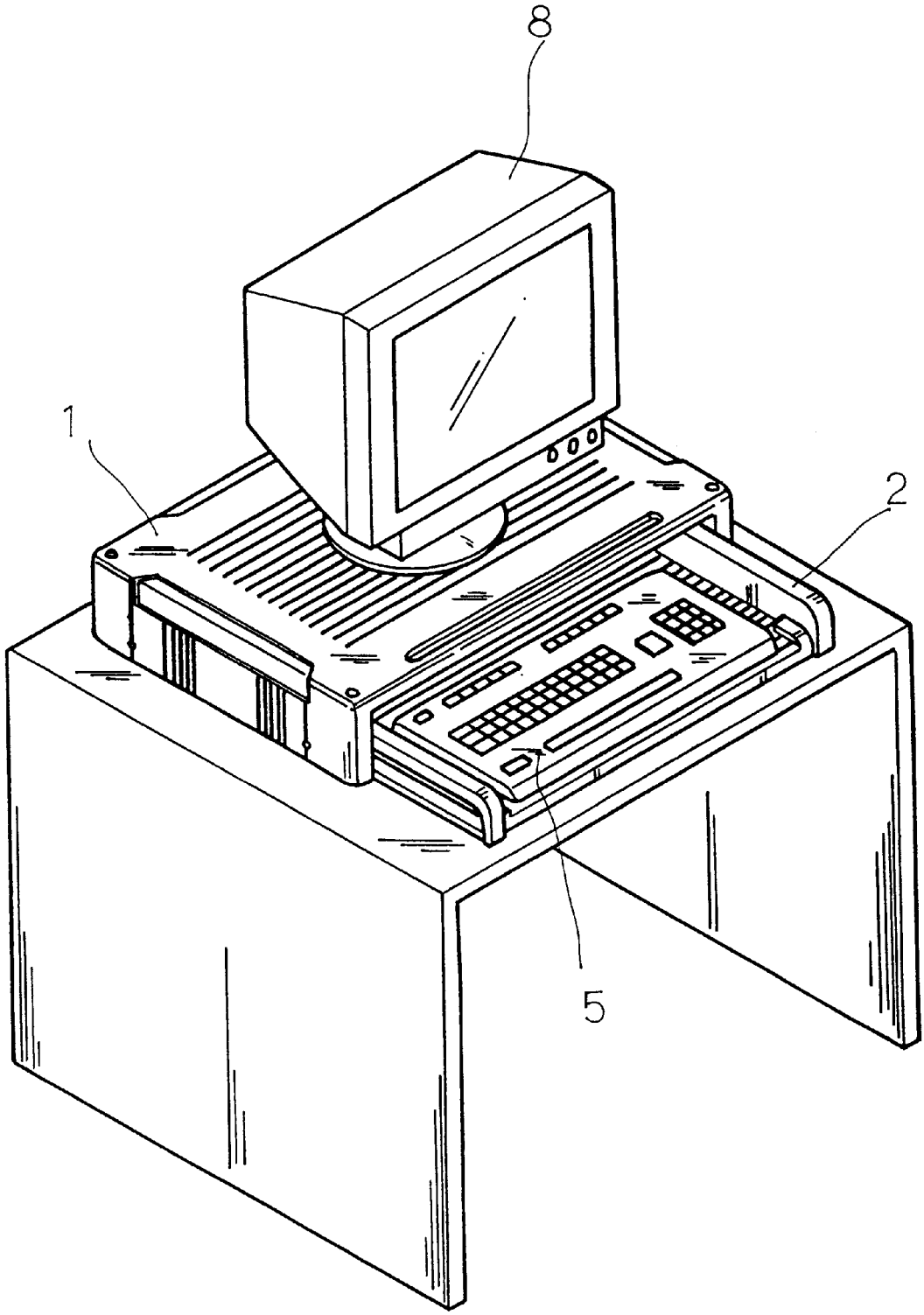
FIG. 6 shows a schematic view of the desktop computer rack of the present invention at work.

As shown in FIGS. 3–6, a desktop computer rack embodied in the present invention is composed of a main body 1, a keyboard plate 2, and two slide rail devices 3. The keyboard plate 2 is slidably located under the main body 1, thanks to the two slide rail devices 3 which are fastened by a plurality of screws 4.

The main body 1 is made integrally of a plastic material. The main body 1 has a rack top 6 which is provided with a plurality of skidproof grooves 7. The main body 1 further has an underside provided with a plurality of reinforcing ribs 11 for enhancing the structural strength of the rack top 6. The main body 1 is provided at four comers thereof with a through slot 9 for accommodating a leg pad 12. The rack top 6 is provided in a front longitudinal side thereof with an elongated through slot 10.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A desktop computer rack comprising a main body, a keyboard plate, and two slide rail devices, said main body having a rack top provided with a skidproof surface and at least one side wall, said main body further having on an underside thereof a plurality of reinforcing ribs, said main body provided respectively at four corners thereof with through holes extending from the rack top through said side wall and opening on an underside of the main body for accommodating respective support legs, said keyboard plate located slidably under said main body by said two slide rail devices which are fastened with said main body and said keyboard plate.

2. The desktop computer rack as defined in claim 1, wherein said main body is made integrally of a plastic material.

3. The desktop computer rack as defined in claim 1, wherein said skidproof surface of said rack top of said main body is provided with a plurality of skidproof grooves.

4. The desktop computer rack as defined in claim 3, wherein said skidproof grooves are substantially parallel to each other.

5. The desktop computer rack as defined in claim 4, wherein said skidproof grooves are arranged substantially parallel to a front edge of said main body.

6. The desktop computer rack as defined in claim 1, further comprising an elongated through slot in a front side of said rack top.

7. A desktop computer rack, comprising:

a main body made integrally of a plastic material;

a keyboard plate;

two slide rail devices;

said main body having a rack top provided with a skidproof surface including a plurality of skidproof grooves and at least one side wall;

said main body further having on an underside thereof a plurality of reinforcing ribs;

said main body provided respectively at four corners thereof with a through holes extending from the rack top through said side wall and opening on an underside of the main body for accommodating respective support legs;

said keyboard plate located slidably under said main body by said two slide rail devices which are fastened with said main body and said keyboard plate; and wherein said skidproof grooves are arranged substantially parallel to a front edge of said main body.

8. The desktop computer rack as defined in claim 7, further comprising an elongated through slot in a front side of said rack top.

* * * * *